United States Patent [19]

Lieberman

[11] 4,232,476

[45] Nov. 11, 1980

[54] CHILDREN'S MASK

[76] Inventor: Arthur M. Lieberman, 60 E. 42nd St., New York, N.Y. 10017

[21] Appl. No.: 940,859

[22] Filed: Sep. 8, 1978

[51] Int. Cl.[3] ..... A63H 3/06

[52] U.S. Cl. ..... 46/88; 46/1 R; 46/175 R; 2/424

[58] Field of Search ..... 46/1 F, 44, 88, 175, 46/182, 1 R, 87; 2/413, 424

[56] References Cited

U.S. PATENT DOCUMENTS 885,802 4/1908 Sterrick ..... 46/88

*Primary Examiner*—Houston S. Bell, Jr.

[57] ABSTRACT

There is described a non-articulated children's mask capable of performing functions in keeping with the fantasy and science fiction creatures now present in books, television and movies. One such function is the ability to see simultaneously both forward and reverse. This is accomplished with the use of adjustable reversing mirrors which eminate sideways from the mask. When speaking, the mask wearer is imparted a mechanical voice by means of a thin metal vibrating disk affixed to the mouthpiece of the mask. Also disclosed is an action arrangement provided by bladders coupled to a mouthpiece which when pressurized, or depressurized, using lung power results in the changing in the size of a portion of the mask.

1 Claim, 6 Drawing Figures

CHILDREN'S MASK

BACKGROUND OF THE INVENTION

There have been a variety of children's masks both for Halloween, home parties, and general purpose use in the marketplace almost from time immemorial.

The trend in these masks generally follows the most notorious of children's novels, or in later days, television series and movies. The masks have taken a variety of forms from the Frankenstein or horror character type, to the bizarre bar scenes from "Star Wars". Likewise the masks have taken a variety of materials to convey those forms, including rigid plastic and vulcanized type rubber, or combinations. Moreover, the masks often come in the form of make-up kits whereby a child may work from a base and make his own creature.

This invention is directed to all such masks and is particularly directed towards adding operating action potential to such masks; in short, masks which perform functions rather than being visually esthetic.

SUMMARY OF THE INVENTION AND OBJECTS

The invention is directed to several mask operating functions, the first of which permits the wearer to see behind him while simultaneously seeing in front of him. Such an arrangement is afforded by a mask having parts cantilevered sideways from the face. Each of the cantilevers includes a first mirror portion rectilinearly adjustable from the second mirror portion, which is adjacent the wearer's eyes. Each of the mirrors turns the image 90° with the two in combination on either side turning the image 180°. The mirrors closest to the eyes in each of the combinations has an aperture for direct viewing.

As a second feature a disk is provided adjacent the mouth of the wearer which turns the voice tones manifested by the wearer into mechanical type of tones by means of a sympathetic vibration in a disk adjacent the mouth of the wearer which emphasizes pure frequencies and thus makes tone qualities "mechanical."

Another feature of the invention as shown in which bladders are employed coupled to a mouthpiece through tubes which, when pressurized or depressurized cause the mask to assume different shapes to the observer.

It is the object of this invention to provide a children's mask which is capable of performing the function of simultaneously permitting the wearer to view forwards and backwards.

It is a further object of this invention to provide a children's mask with the ability to exhibit mechanical type tones.

It is a further object of this invention to provide a children's mask with the ability to vary positions of its size.

It is a further object of this invention to satisfy the foregoing objects with mask modifications which are extremely inexpensive, safe and capable of mass production techniques.

The foregoing and other objects and advantages of the invention will become apparent to those skilled in the art by a reading of the following embodiments described in connection with the appended drawings in which.

Figure 1:
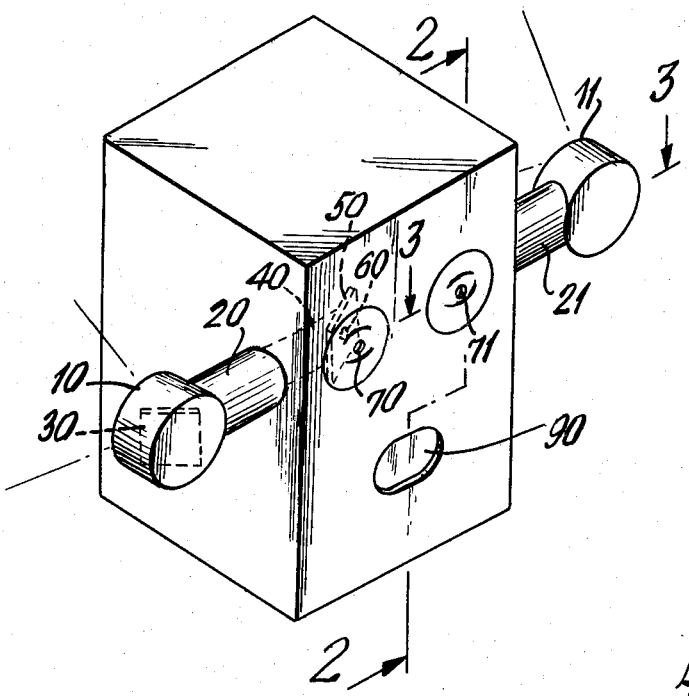
FIG. 1 is a perspective of a child's mask carrying the inventive features.

Turning now to FIG. 1, a simplistic mask is shown. So as not to detract from the invention to be disclosed herein, the mask is shown in almost boxlike form. It will be appreciated however, by those skilled in the art that the mask may take any form dictated by the functional requirements of the invention and the additional requirement that it properly fit the head of the wearer. In some cases this will mean that the particular dimensions of the mask are appropriate to the size of the head. In others there will be an internal lace or strap arrangement as those found in football helmets. The mask may be made of almost any conventional materials which are safe for wearer and are conventionally used for masks. As will be described hereinafter certain requirements of the invention require rigid structure on the masks. Such rigid structures may be supplied on rubber type masks by rigid plastic portions, such plastic portions being sufficient in material thickness and size to maintain the desired mask configuration.

In FIG. 1 there will be seen the rearward viewing "eyes" 10 and 11 cantilevered substantially perpendicular to the center line of the mask face, and when the mask is worn, parallel to the ground. Each of "eyes" 10 and 11 carries within it outside tube portions 20 and 21 which are generally cylindrical and include at the extreme ends thereof mirrors 30 and 31. Mirrors 30 and 31 are at an attitude of approximately 45° to the axial plane of the tube upon which they are carried. These mirrors may be planar or convex, it being understood that if convex they will carry back a scene to the wearer substantially greater in "field" than a planar mirror. The mirror may take various forms and be mounted in various manners to the tubes. For example, convex or spherical type mirrors can be formed by over-stretched mylar. Planar mirrors may be highly polished thin sheets of steel or tin. Suffice it to say almost any of the known forms of mirrors would be adaptable, but it is recommended that because of the invention being for child use, glass mirrors be avoided.

Figure 2:
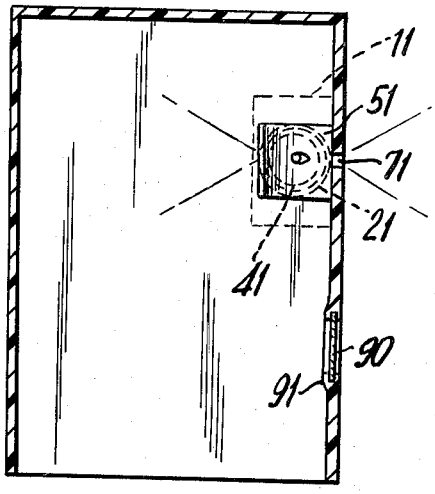
FIG. 2 is a section along the lines 2—2 of FIG. 1.
Figure 3:
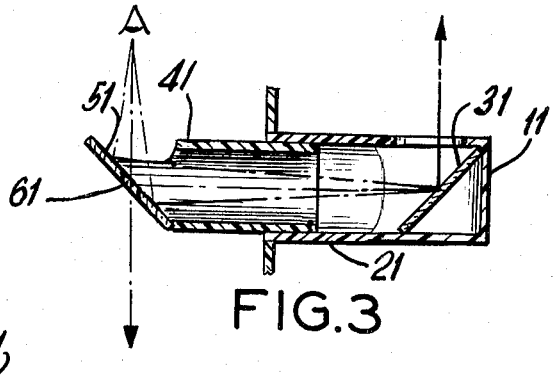
FIG. 3 is a detail of the telescoping mirror arrangement (one side)

Referring to FIGS. 1–3, sliding coaxially adjustable within tubes 20 and 21 are tubes 40 and 41 which carry the primary mirrors 50 and 51. The sliding relationship with the tubes permits the mirrors 50 and 51 to be brought into proximity of the eyes of the wearer and adjusted to permit the viewing the invention affords. These mirrors are also disposed at 45° to the axis of the tubes, however, the axis of this mirror is at 90° to the axis of the external mirrors 30 and 31. These mirrors are preferably planar and include at their center apertures 60 and 61.

Apertures 60 and 61 are approximately one-eighth to one-quarter inches in diameter and permit the viewer to look through the mirror and the mask (through associated mask apertures 70 and 71), or to look around the apertures and thereby see behind the mask by the double reflections from two mirrors.

The adjustability feature of the sliding tubes (20 and 40, and 21 and 41) permit adjustment to precise eye positions. Needless to say additional adjustment may be given by an adjustable webbing or shims within the mask (not shown) if necessary to adjust the mask height with respect to the face.

Significantly in the arrangement shown, several features are now apparent. First, although there is image reversal, there is no periscope effect, that is, the images are not reversed upside down, rather they are reversed left to right.

Since it is not anticipated that a child will steer backwards, this should not produce a problem. The arrangement is extremely inexpensive since no reversing lens is required internally. Moreover, those skilled in the art will immediately recognize certain potential modifications. Rather than having the mirrors 30 and 31 including apertures 60 and 61, half-silvered mirrors may be employed obviating the need for apertures but reducing by more than half (including the mirror efficiency) the available light.

Another alternative arrangement is to eliminate both the aperture in the mirror and one complete set of reversing mirrors and tubes. Thus, for example, the right eye would include the system as shown in FIG. 1 (less the aperture 60), the left eye would look directly through the hold 91 in the mask. Thus, by working one eye or the other, the viewer would either see forward or backwards.

This arrangement as well reduces the amount of light simply by reducing the number of eyes capable of seeing it. All in all, the embodiment depicted in FIG. 1 is deemed to be the best.

Also shown in FIG. 1 is a disk 90. Disk 90 is approximately 2 to 3 inches in length and 1 to 2 inches in height, configured generally in oval form. The disk is thin metal or plastic within the range of from 25–300 microns thick, i.e., from thinner than a piece of paper to several sheets of paper thick.

Empirically different shapes and thicknesses can be arrived at, however, the range shown will produce sympathetic vibrations to voice tones resulting in mechanical sound eminating from the mask.

Preferably the disk is firmly fastened about its periphery to the mask itself. This may be done by any of the heat setting techniques in which a lip is formed in the mask and firmly embraces the speaking disk 90. Such lip is shown in cross-section in FIG. 2 at 91. Alternatively, rivets glue or any other firm fastening arrangement may be used.

Figure 4:
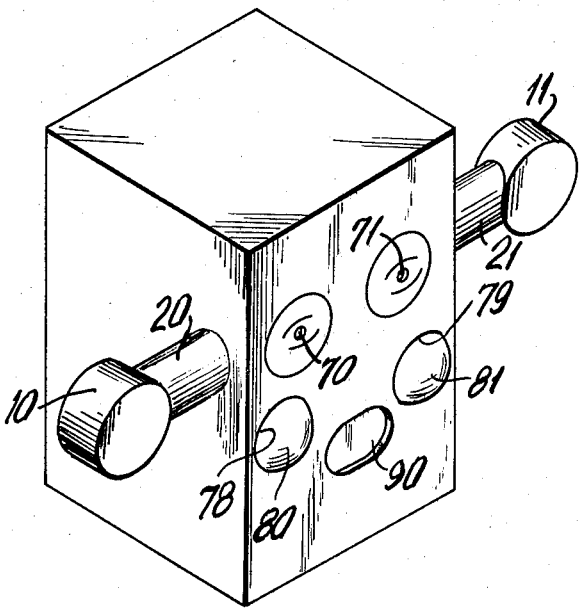
FIG. 4 illustrates the addition of cheek puffs.
Figure 5:
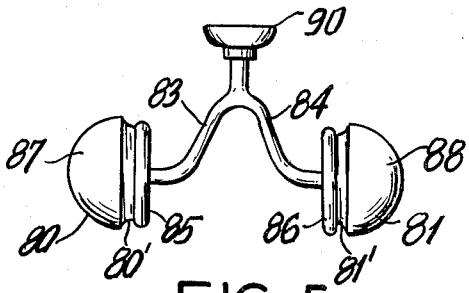
FIG. 5 is a detail of the cheek puffing mechanism.

Turning now to FIG. 4, there may be seen a further authorization of the mask in which the cheek portions include apertures 78 and 79 within which are mounted bladders 80 and 81. Bladders 80 and 81 may be conventionally mounted within the mask by virtue of their reduced sections 80' and 81' dimensioned to closely fit within the mask apertures 78 and 79. Each of the bladders 80 and 81 include firm surfaces 85 and 86, respectively and expandable surfaces 87 and 88, respectively. These may be provided by making the sections 85 and 86 of substantially thicker expandable material, such as rubber, thereby requiring any pressure within the bladder to act primarily (in the sense) upon the thinner surfaces 87 and 88. Bladders 80 and 81 are hermetically coupled via tubes 83 and 84 to mouthpiece 90 which the wearer grips in his teeth, much the same as a snorkle mouthpiece. As will be appreciated from the foregoing description when the wearer blows through the mouthpiece, and hence tubes 83 and 84, bladders 80 and 81 will expand. Inhaling will produce the reverse result. As a consequence, the cheeks of the mask will go in and out at a rate dictated by the wearer. Mouthpiece 95 may hand loosely within the mask and therefore may be used in conjunction with mechanical tone piece 90.

As will be further appreciated by those skilled in the art, some of the new types of masks employ make-up, consequently bladders may be disguised and worked in as part of the mask visually. Furthermore, the entire cheek portions may have an overlay of more flexible material (not shown) which entire flexible material may move as an envelope, softening the effect.

Figure 6:
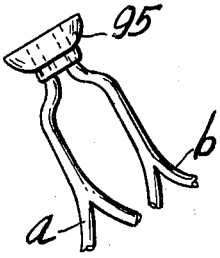
FIG. 6 illustrates a modification of the puffing arrangement of FIG. 5.

The disclosed arrangement may also be used for causing the eyes to puff, the ears to puff, etc., there being no restriction on use. Further, a plurality of such arrangements may be provided with several tubes connected to the mouthpiece and with the tongue employed as a gate to cover the tube through which no action is desired. Thus, for example, as shown in FIG. 6 two fork tubes "a" and "b" are connected to the mouthpiece 95. With the tongue over the "a" tube, all action will occur via the "b" tube which could, for example, be coupled to the cheeks. With the tongue over the "b" tube, the action would be imparted to the "a" tube which could, for example, be the ears.

It will be appreciated from the foregoing description of the embodiments of the invention that variations and modifications to the specifically disclosed embodiments may become apparent to those skilled in the art without necessarily departing from the spirit and scope of the invention.

What is claimed is:

1. In a children's mask the combination comprising a plurality of bladders mounted on said mask for changing the size of the accompanying portions of said mask; a mouthpiece having a plurality of apertures mounted on said mask, and a plurality of flexible tubes coupling said apertures to said bladders whereby the tongue may act as a gate to seal predetermined of said apertures and activate the remaining thereof to expand the associated bladders.

* * * * *